US010436542B1

(12) United States Patent
Karcher

(10) Patent No.: US 10,436,542 B1
(45) Date of Patent: Oct. 8, 2019

(54) ARCHERY BOW PEEP SIGHT

(71) Applicant: Bear Archery, Inc., Evansville, IN (US)

(72) Inventor: Daniel Karcher, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 16/259,181

(22) Filed: Jan. 28, 2019

(51) Int. Cl.
*F41G 1/467* (2006.01)
*F41B 5/14* (2006.01)

(52) U.S. Cl.
CPC ..... *F41B 5/1419* (2013.01); *F41G 1/467* (2013.01)

(58) Field of Classification Search
CPC ..... F41G 1/467; F41B 5/1419
USPC ..... 124/90; 33/265
See application file for complete search history.

(56) References Cited

U.S. PATENT DOCUMENTS 3,410,644 A * 11/1968 McLendon ..... F41G 1/467 356/247
3,703,770 A * 11/1972 Sofield ..... F41G 1/08 33/265
3,703,771 A * 11/1972 Saunders ..... F41G 1/08 33/265
4,011,853 A * 3/1977 Fletcher ..... F41G 1/467 124/87
4,454,857 A 6/1984 Miller et al.
4,625,422 A * 12/1986 Carlson ..... F41G 1/467 124/87
4,656,747 A * 4/1987 Troncoso ..... F41G 1/467 124/87
4,934,332 A * 6/1990 Scherz ..... F41B 5/1419 124/87
4,965,938 A * 10/1990 Saunders ..... F41G 1/467 124/87
5,056,498 A * 10/1991 Scherz ..... F41B 5/1419 124/87
5,080,084 A * 1/1992 Kendall ..... F41G 1/345 124/87
5,325,598 A * 7/1994 Hall ..... F41B 5/1419 33/265
5,347,976 A * 9/1994 Saunders ..... F41G 1/467 124/87
5,379,747 A * 1/1995 Morris ..... F41G 1/467 124/87
5,379,748 A * 1/1995 Carlson ..... F41G 1/467 124/87
5,542,186 A * 8/1996 Saunders ..... F41B 5/1419 33/265
5,762,059 A 6/1998 Strope
5,860,408 A * 1/1999 Summers ..... F41G 1/467 124/87
5,996,569 A * 12/1999 Wilson ..... F41B 5/1419 124/87

(Continued)

*Primary Examiner* — Alexander R Niconovich
(74) *Attorney, Agent, or Firm* — Woodard, Emhardt, Henry, Reeves & Wagner, LLP; Charles Meyer

(57) ABSTRACT

A serve-less peep sight is configured for use with an archery bow with bowstring fibers. The fibers are separated into two groups that diverge at an upper junction and converge at a lower junction. The peep sight is installed with the bowstring fibers extending around an upper portion and a lower portion and with the fibers crossing within a transverse channel. The peep sight is locked in place when the bowstring is under tension without the need to use serving material.

19 Claims, 5 Drawing Sheets

(56) References Cited

U.S. PATENT DOCUMENTS 6,170,164 B1 * 1/2001 Knowles ..... F41G 1/467 124/87
6,282,800 B1 * 9/2001 Beutler ..... F41G 1/467 124/87
6,860,021 B1 * 3/2005 Connelly ..... F41B 5/1419 33/265
6,981,329 B1 * 1/2006 Strathman ..... F41B 5/1419 33/265
7,040,027 B1 * 5/2006 Shaffer ..... F41B 5/1419 33/265
7,266,896 B1 * 9/2007 White ..... F41G 1/467 124/90
7,543,389 B2 * 6/2009 Grace, Jr. ..... F41B 5/1419 33/265
7,543,390 B2 * 6/2009 Bach ..... F41G 1/467 124/87
7,698,824 B2 * 4/2010 Wilson ..... F41G 1/01 124/87
8,191,544 B2 * 6/2012 Buck ..... F41G 1/467 124/87
8,201,339 B1 * 6/2012 Walker ..... F41G 1/467 124/87
8,281,777 B2 * 10/2012 Bach ..... F41B 5/1426 124/87
8,336,533 B2 * 12/2012 Bach ..... F41B 5/14 124/92
8,453,336 B2 * 6/2013 LoRocco ..... F41G 1/467 124/87
8,544,180 B2 * 10/2013 Minica ..... F41G 1/467 124/90
8,898,914 B2 * 12/2014 Bruder ..... F41G 1/467 124/87
D781,981 S 3/2017 Wolf
D797,231 S 9/2017 Lemburg
9,829,278 B2 * 11/2017 Wolf ..... F41B 5/1419
10,161,719 B2 * 12/2018 Burgaleta Sanchez ..... F41B 5/1419
2016/0169613 A1 * 6/2016 Wolf ..... F41B 5/1419 124/87
2018/0087874 A1 * 3/2018 Wolf ..... F41B 5/1419

* cited by examiner

ARCHERY BOW PEEP SIGHT

FIELD OF THE DISCLOSURE

The present disclosure relates generally to archery bows and more particularly pertains to a peep sight for use with archery bows.

BACKGROUND

Many archers mount a peep sight in the bowstring of their bow to help in aiming the bow and an arrow. A peep sight defines a small aiming window. During the aiming process, an archer typically lines up the peep sight aiming window with an aiming point of a front sight mounted on the bow riser in order to align the archer's shot.

Typically a peep sight is installed when a bowstring is not under tension, for instance with the bow held by a bow press. A bowstring is commonly made of multiple strands or fibers that are wound together to form a single bowstring. When installing a peep sight, the strands or fibers of the bowstring are separated into two groupings or bundles at the desired mounting location. The peep sight is then mounted between the bowstring bundles. Ideally half of the fibers are arranged on each side of the peep sight, although this can be adjusted to control how much the peep sight torques when the bow is drawn. To hold the peep sight in place, one or two further pieces of fiber or "serving material" are then wrapped around the bowstring above and below the peep sight. These tie the peep sight in place on the bowstring and keep it from moving upward or downward. The wrapping process is called "serving."

SUMMARY

Figure 1:
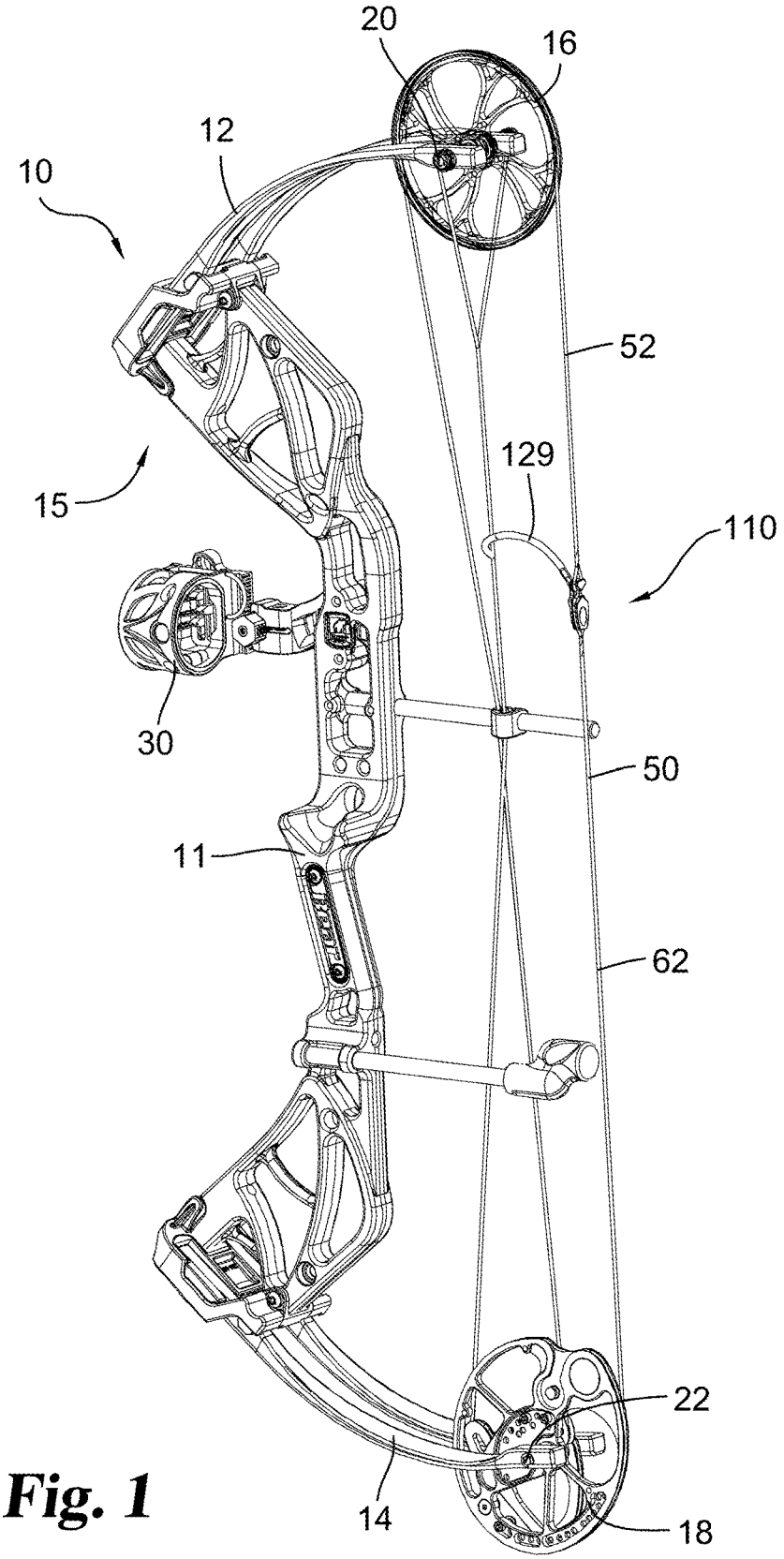
FIG. 1 is a side view of a single cam bow in an undrawn position incorporating a peep sight according to an embodiment of the present disclosure.

Embodiments of the present disclosure provide a "serve-less" peep sight for use with an archery bow. A representative embodiment includes a peep sight having a peep sight body defining a sight window through the body and defining a pair of lateral side edges. The peep sight body includes an upper portion and a lower portion with a transverse passage defined between the upper portion and the lower portion. The peep sight body is configured to receive a plurality of bowstring fibers separated into two fiber bundles. The peep sight body defines respective paths for the pair of fiber bundles along opposing lateral sides of the upper portion. The paths of the two fiber bundles intersect and cross within the transverse passage. The peep sight body also defines respective paths for the pair of fiber bundles along opposing lateral sides of the lower portion. Each fiber bundle path is adjacent one lateral side of the peep sight body along the upper portion and adjacent the opposite lateral side of the peep sight body along the lower portion An alternate embodiment constitutes a peep sight body defining a sight window through the body and defining a pair of lateral side edges. The peep sight body includes an upper portion and a lower portion with a transverse passage defined between the upper portion and the lower portion. A plurality of bowstring fibers are separated into two bundles between an upper junction where the bundles diverge and a lower junction where the bundles converge. The two bundles engage the peep sight body in a figure-eight shaped arrangement with the upper portion of the peep sight body extending through the upper loop of the figure-eight and the lower portion of the peep sight body extending through the lower loop of the figure-eight. The two bundles cross within the transverse passage.

Certain embodiments provide a peep sight for an archery bow having a bowstring formed of a plurality of fibers. The peep sight includes an upper portion with a pair of lateral sides and the lower portion with a pair of lateral sides. The upper portion and lower portion are vertically spaced apart to define a transverse passage. A sight window is defined through at least one of the upper portion and the lower portion. The bowstring fibers diverge at an upper junction and converge at a lower junction. Each fiber passes along one lateral side of the upper portion, passes along the opposite lateral side of the lower portion, and switches from one lateral side to the opposite lateral side within the transverse passage.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the disclosure relates.

Embodiments of the present disclosure provide a "serve-less" peep sight for use with an archery bow with bowstring fibers that diverge at an upper junction and converge at a lower junction. The serve-less peep sight is installed with the bowstring fibers crossing within a transverse channel. This locks the peep sight in place when the bowstring is under tension without the need to use serving material.

FIG. 1 illustrates a representative example of an archery bow 10 incorporating a peep sight 110 according to the present disclosure. Bow 10 includes a riser 11 with a handle, an upper limb or pair of limbs 12 and a lower limb or pair of limbs 14. In the single cam example illustrated, rotational members such as idler wheel 16 and eccentric cam 18 are supported at the limb tip sections for rotary movement about axles 20 and 22. In the embodiment shown, upper and lower limbs are formed of parallel and symmetric limbs sometimes called a quad limb arrangement. Alternately, a single piece limb can have a notch or slot area removed to allow a rotational element to be mounted to the limb tips. An upper pulley axle 20 is carried between the outer limb tip portions of upper limb 12. A lower pulley axle 22 is carried between the outer limb tip portions of lower limb 14.

The portion of the cable which defines the bowstring 50 includes an upper portion 52 and a lower portion 62 which are fed-out from idler wheel 16 and cam 18 when the bow is drawn. The upper portion 52 may be part of a longer cable which has a medial portion mounted around idler wheel 16 with the ends mounted to cam 18. The non-bowstring portion of the cable extending from wheel 16 to cam 18 can be referred to as the return cable portion. Additionally, a y-yoke anchor cable has a lower end mounted to cam 18 which extends to two upper ends mounted adjacent opposing ends of axle 20. Each cable has a thickness and a round cross-section defining a circumference. From the perspective of the archer, the bowstring is considered rearward relative to the riser which defines forward.

When the bowstring 50 is drawn, it causes idler wheel 16 and cam 18 at each end of the bow to rotate, feeding out cable and bending limbs 12 and 14 inward, causing energy to be stored therein. When the bowstring 50 is released with an arrow engaged to the bowstring, the limbs 12 and 14 return to their rest position, causing idler wheel 16 and cam 18 to rotate in the opposite direction, to take up the bowstring 34 and launch the arrow with an amount of energy proportional to the energy initially stored in the bow limbs. Bow 10 is described for illustration and context and is not intended to be limiting.

While not illustrated, embodiments of the present disclosure can also be used in other types of bows, for example dual cam or two cam bows, hybrid cam bows or recurve bows which are considered conventional for purposes of the present disclosure. For convenience, the combination of riser 11 and either single or quad limbs forming upper limb 12 and lower limb 14 may generally be referred to as archery bow body 15. Accordingly, it should be appreciated that the archery bow body can take on various designs in accordance with the many different types of bows with which the present disclosure can be used.

Various accessories, such as sights, arrow rests, stabilizers and quivers can be mounted to bow body 15. Commonly, a peep sight is used in combination with a forward sight 30. A forward sight is typically mounted to or formed as part of riser 11 above the arrow rest position. A forward sight typically defines at least one aiming point. Some sights, such as illustrated forward sight 30, define multiple aiming points corresponding to different distances.

Figure 2:
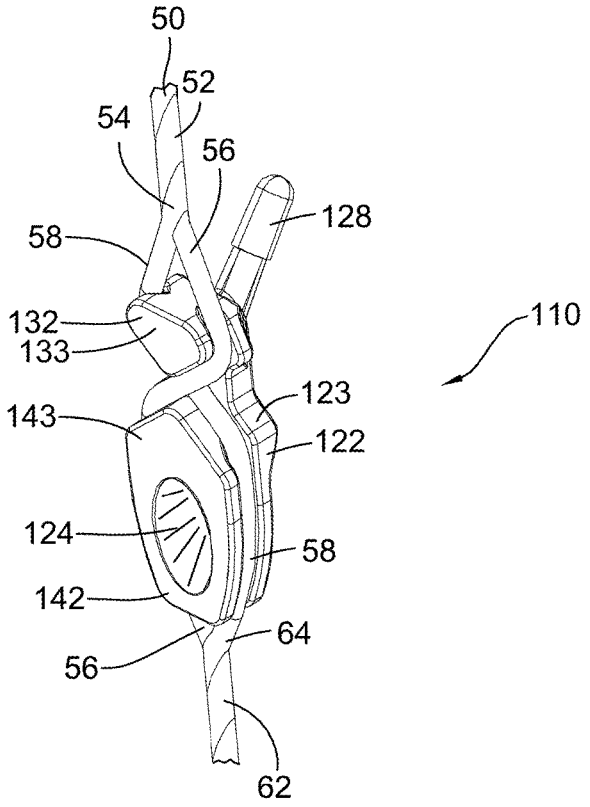
FIG. 2 is a perspective enlarged view of a portion of the bowstring and the peep sight of FIG. 1.
Figure 3:
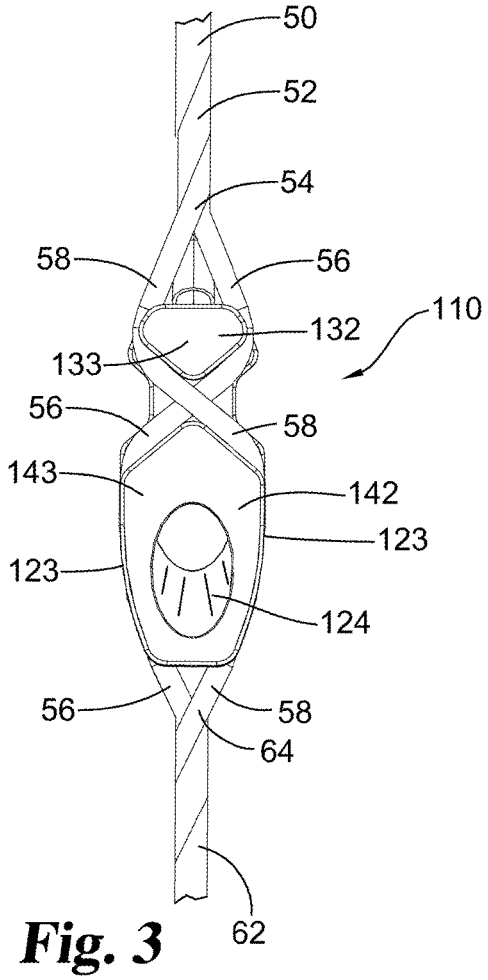
FIG. 3 is a front view of the bowstring and peep sight of FIG. 2.
Figure 4:
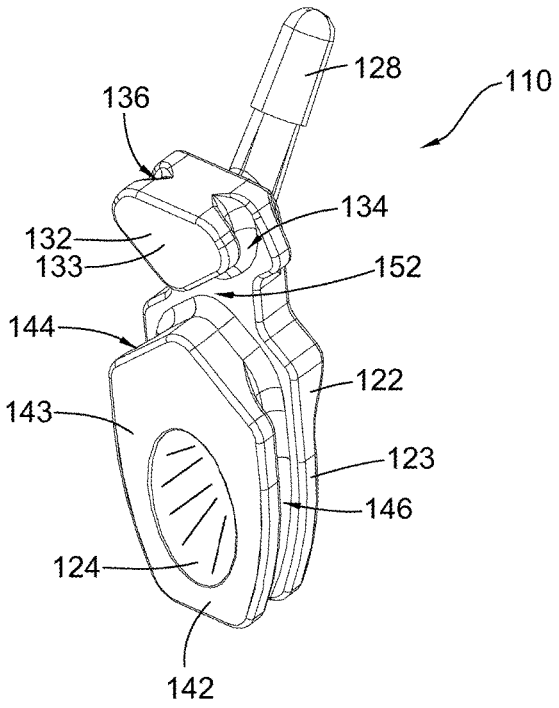
FIG. 4 is a perspective view of the peep sight of FIG. 2 without the bowstring.
Figure 5:
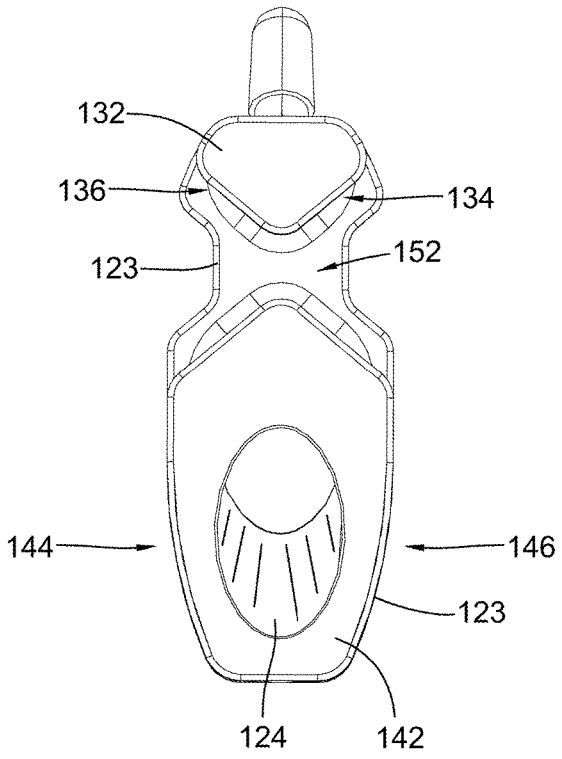
FIG. 5 is a rear view of the peep sight of FIG. 4, which is the side facing the archer.
Figure 6:
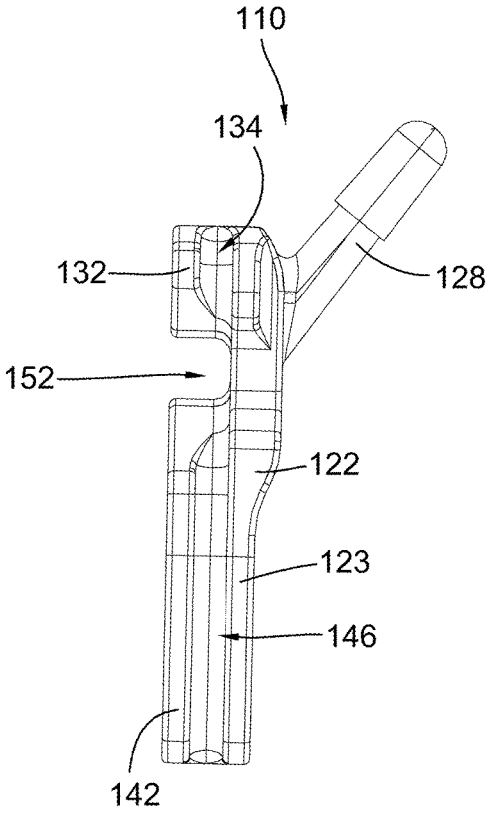
FIG. 6 is a side view of the peep sight of FIG. 4. The opposite side view is a mirror image.
Figure 7:
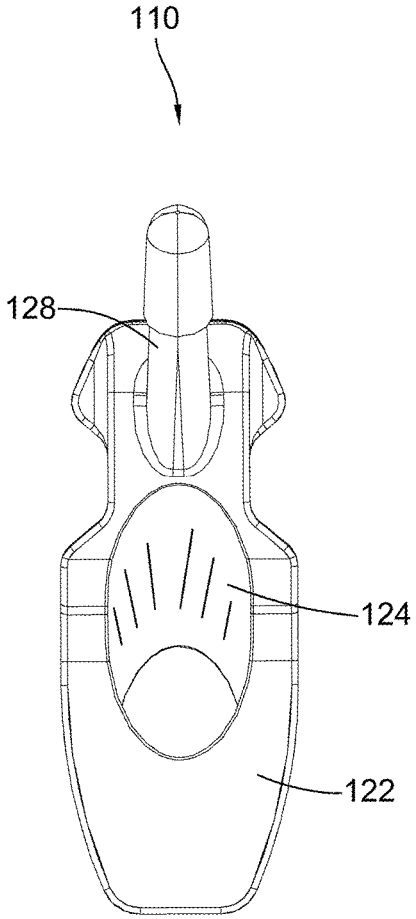
FIG. 7 is a front view of the peep sight of FIG. 4, which is the side facing toward the bow riser.
Figure 8:
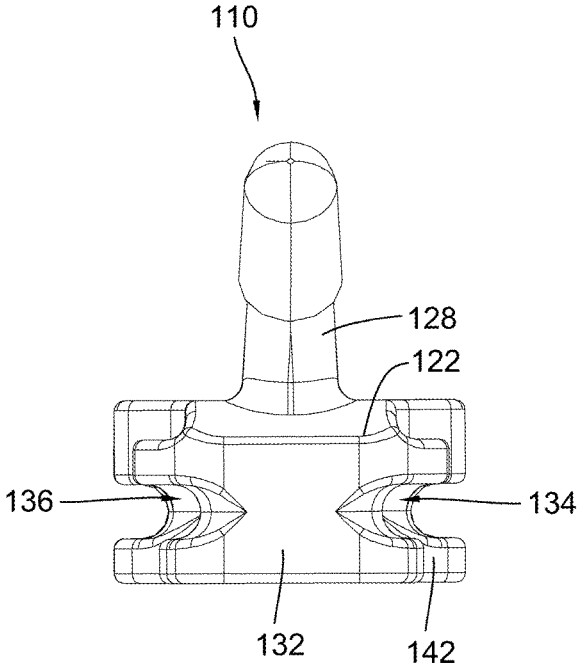
FIG. 8 is a top end view of the peep sight of FIG. 4.
Figure 9:
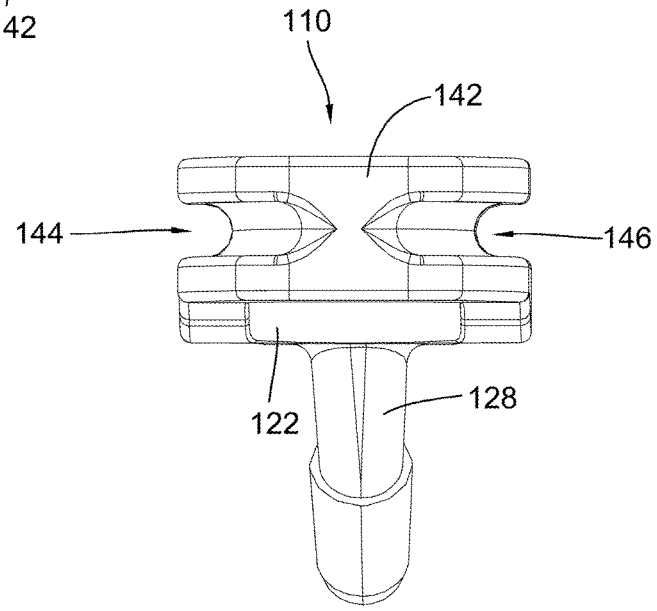
FIG. 9 is a lower end view of the peep sight of FIG. 4.

FIGS. 2-3 illustrate a portion of bowstring 50 and peep sight 110 in greater detail. FIGS. 4-9 illustrate peep sight 110 without the bowstring for ease of reference. Peep sight 110 includes a base portion 122. Base portion 122 is formed to extend vertically, for instance along the front side of peep sight 110. Base portion 122 defines a pair of opposing lateral side edges 123. Lateral side edges 123 extend predominantly in a vertical orientation, although they may have curved or indented profiles. In the illustrated embodiment base portion 122 has a longer length than width and has a proportionately narrow thickness, for instance forming a plate-like base. As installed, base portion 122 has a vertical planar orientation with the front face of base portion 122 oriented toward bow body 15. Upper portion 132 and lower portion 142 each extend rearward from base portion 122. Base portion 122, upper portion 132 and lower portion 142 in combination form a peep sight body. Proportionally, base portion 122 may define upper and lower lobes separated by a narrower portion, defining an approximately figure-eight or hourglass shaped profile.

Upper portion 132 is illustrated with an approximately triangular profile and cross-section extending perpendicularly rearward as an upper lobe from base portion 122. The hypotenuse of the triangle faces upward and the triangle may define a downward facing rounded apex. Upper portion 132 defines a cap portion 133 with a rearward face. Cap portion 133 is connected to base portion 122 via a central portion. Cap portion 133 is separated from base portion 122 by the width of upper side grooves 134, 136. Upper side grooves 134, 136 define a width and depth forming channels along both sides of upper portion 132 and are separated by the central portion. The grooves define sufficient width and depth to engage and retain a bundle of bowstring fibers. Cap portion 133 is connected to base portion 122 between the upper side grooves, with edges of the cap portion extending to define the rearward edges of the side grooves.

Lower portion 142 is illustrated with an approximately pentagonal profile and cross-section extending perpendicularly rearward as a lower lobe from base portion 122. As illustrated, lower portion 142 is approximately a pentagon shape with curved edges and corners, with a lower edge transitioning to a pair of upward extending and slightly diverging side edges.

The side edges transition to inward converging upper edges which meet in an upward pointing apex aligned with the downward pointing apex of upper portion 132. Upper portion 132 and lower portion 142 are separated by transverse passage 152. Lower portion 142 defines a cap portion 143 with a rearward face. Cap portion 143 is connected to base portion 122 via a central area. Cap portion 143 is separated from base portion 122 by the width of lower side grooves 144, 146. Lower side grooves 144, 146 define a width and depth forming channels along both sides of lower portion 142 and are separated by the central portion. The grooves define sufficient width and depth to engage and retain a bundle of bowstring fibers. Cap portion 143 is connected to base portion 122 between the lower side grooves, with edges of the cap portion extending to define the rearward edges of the side grooves.

The central portion of lower portion 142 preferably is sized with a sufficient length and width to allow sight window 124 to extend through peep sight 110. Sight window 124 extends rearward-to-frontward through lower portion 142. Sight window 124 may be vertically angled relative to the plane of base portion 122. When the bowstring is drawn, upper bowstring portion 52 changes orientation and extends at an angle relative to its vertical brace orientation. Correspondingly, peep sight 110 assumes an angled orientation. The sight window 124 is angled in the brace position so that as the peep sight becomes angled when drawn, sight window 124 changes orientation and becomes horizontal. Sight window 124 can then be aligned along an axis with an aiming point on forward sight 30.

An optional alignment arm 128 may extend forward and upward from the front of base portion 122. When alignment arm 128 is used, an elastic tube or cord 129 (FIG. 1) may extend from alignment arm 128 and is secured, for example with a knot, to the anchor cable or to a mounting point on the bow body 15. The tube or cord 129 applies a slight pulling tension to alignment arm 128 when bow 10 is drawn to assist in keeping the peep sight window 124 aligned rearward to forward and in alignment with forward sight 30. Peep sight 110 may be used with or without alignment arm 128 being connected to a tube or cord 129. In alternate embodiments, peep sight 110 is made without alignment arm 128.

Aspects of the present disclosure allow embodiments of peep sight 110 to be mounted to bowstring 50. Preferably peep sight 110 can be mounted without serving material needing to be applied to the bowstring. As illustrated in detail in FIGS. 2-3, as upper bowstring portion 52 approaches the location of peep sight 110, the bowstring strands are separated and grouped into two bundles 56, 58. The bundles diverge at junction 54. Ideally, the strands are evenly divided between the bundles. Alternately, the strands can be divided in unequal groups to help maintain peep sight 110 in alignment. The peep sight is installed while the bowstring is not under tension, for example with the bow held in a bow press.

As bundles 56, 58 approach the upper end of peep sight 110, the bundles are respectively received on opposing sides of upper portion 132 and enter side grooves 134, 136. The paths of bundles 56, 58 follow the periphery around upper portion 132 and into transverse passage 152. The paths of bundles 56, 58 intersect and cross-over each other within transverse passage 152, for example within the space defined between the downward pointing apex of upper portion 132 and the upward pointing apex of lower portion. The paths of bundles 56, 58 then continue downward and are received on opposing sides of lower portion 142 in side grooves 144, 146. The paths of bundles 56, 58 follow the periphery around lower portion 142, where bundles 56, 58 exit side grooves 144, 146. Bundles 56, 58 then converge to junction 64 and continue as lower bowstring portion 62.

The cross-over of bundles 56, 58 within transverse passage 152 causes the bundles to switch sides between upper portion 132 and lower portion 142. For instance, bundle 56 may be in upper right side groove 134 (from an archer's perspective), then the path of bundle 56 traverses across the width of peep sight 110 within passage 152 and continues within a left side groove 144 of lower portion 142. In a mirror image, bundle 56 may be in upper left side groove 136 of upper portion 132 and changes to right side groove 146 of lower portion 142. References to left and right herein are for purposes of illustration and are not intended to be limiting.

Bundles 56, 58 form a figure-eight or hourglass shaped profile between junctions 54 and 56 with the bundles crossing each other in the middle. Upper portion 132 of peep sight 110 extends through and is encircled by the upper loop of the figure-eight and lower portion 142 extends through and is encircled by the lower loop of the figure-eight.

Longitudinal tension is applied to bowstring 50 when the bow is removed from the bow press. The tension causes the bundles and the pair of loops to tighten around peep sight 110, locking the peep sight 110 in the desired location along bowstring 50. The crossing of the bundles also holds the bundles together, limiting further unwinding and separation along the length of the bowstring. If needed, the location of peep sight 110 can be adjusted along the length of bowstring 50 by placing the bow into a bow press to relieve the tension on the bowstring and then adjusting the peep sight between the bowstring strands to a selected location.

An example method of installation includes initially relieving tension on a bowstring, for example by placing bow 10 in a bow press. The fibers of bowstring 50 are then gathered into two groups or bundles 56, 58 diverging at junction 54. Upper portion 132 of peep sight 110 is then placed between bundles 56, 58 so that bundles 56, 58 are arranged in opposing side grooves 134, 136 of upper portion 132.

Bundles 56, 58 are then inserted and threaded through a central transverse passage 152 of the peep sight so that the bundles cross-over each other to switch between their respective lateral sides of the peep sight. For instance, one bundle of fibers may be laid over the other bundle of fibers at the crossing point within passage 152. Lower portion 142 of peep sight 110 is then placed between bundles 56, 58 so that bundles 56, 58 are arranged in opposing side grooves 144, 146 of lower portion 142 and so the bundles then exit downward from side grooves 144, 146. Bundles 56, 58 then converge to junction 64 and combine to continue as lower bowstring portion 62. Tension is then applied to bowstring 50 to lock peep sight 110 in place, for example by releasing bow 10 from the bow press.

References to upper, lower, forward, rearward and to bundles 56, 58 approaching or exiting respective side grooves are for ease of reference to the illustrated embodiment of peep sight 110. In alternate embodiments, a peep sight body may have a sight window in an upper portion rather than a lower portion. In certain embodiments the base plate may be on the rear side of the bowstring, with the upper and lower portions extending forward, with appropriate adjustments as will be understood by those of skill in the art, such as the angle of sight window 124. In variations on the method of installing peep sight 110, bundles 56, 58 may be first arranged on opposing sides of lower portion 142 before being arranged on opposing sides of upper portion 132.

In certain embodiments, base portion 122, upper portion 132 and lower portion 142 form a peep sight body formed as one integral piece, for example of molded plastic. In alternate embodiments, upper portion 132 and lower portion 142 may be connected to base portion with fasteners such as screws, bolts, clips and/or adhesive. In further alternate embodiments, the peep sight body may be formed as two pieces which can be snapped, clipped or fastened together. The two pieces can be arranged in front of and behind the bowstring with a pair of portions extending between them and extending between separated bowstring bundles 56, 58. The two pieces and pair of portions define respective pathways in which bundles 56, 58 are received and arranged to cross to form a figure-eight or hourglass shaped profile While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed:

1. A peep sight for an archery bow, comprising:

a. a peep sight body defining a sight window through the body and defining a pair of lateral side edges, the peep sight body including an upper portion and a lower portion with a transverse passage defined between the upper portion and the lower portion;

b. wherein the peep sight body is configured to receive a plurality of bowstring fibers separated into two fiber bundles;

c. wherein the peep sight body defines respective paths for the two fiber bundles along opposing lateral sides of the upper portion;

d. wherein the paths of the two fiber bundles intersect and cross within the transverse passage;

e. wherein the peep sight body defines respective paths for the two fiber bundles along opposing lateral sides of the lower portion; and, f. wherein each fiber bundle path is adjacent one lateral side of the peep sight body along the upper portion and adjacent the opposite lateral side of the peep sight body along the lower portion.

2. The peep sight of claim 1 wherein the peep sight body includes a base portion with the upper portion and the lower portion extending rearward from the base portion.

3. The peep sight of claim 2, wherein the upper portion has a triangular profile.

4. The peep sight of claim 2, wherein the lower portion has a pentagonal profile.

5. The peep sight of claim 2, wherein upper portion has a downward pointing apex aligned with an upward pointing apex of the upper portion.

6. The peep sight of claim 2 wherein the paths for the two fiber bundles along opposing lateral sides of the upper portion are a pair of upper side grooves, and wherein the paths for the two fiber bundles along opposing lateral sides of the lower portion are a pair of lower side grooves.

7. The peep sight of claim 6, wherein the upper portion defines a cap portion connected to the base portion between the upper side grooves, with edges of the cap portion extending to define rearward edges of the upper side grooves, and wherein the lower portion defines a cap portion connected to the base portion between the lower side grooves, with edges of the cap portion extending to define rearward edges of the lower side grooves.

8. The peep sight of claim 2, wherein the base portion, the upper portion and the lower portion are formed as an integral piece.

9. The peep sight of claim 2, comprising an alignment arm extending forward and upward from the front of the peep sight body.

10. A peep sight for an archery bow, comprising:

a. a peep sight body defining a sight window through the body and defining a pair of lateral side edges, the peep sight body including an upper portion and a lower portion with a transverse passage defined between the upper portion and the lower portion;

b. a bowstring formed of a plurality of fibers, wherein the fibers are separated into two bundles between an upper junction where the bundles diverge and a lower junction where the bundles converge; and, c. wherein the two bundles engage the peep sight body in a figure-eight shaped arrangement with the upper portion of the peep sight body extending through the upper loop of the figure-eight and the lower portion of the peep sight body extending through the lower loop of the figure-eight, and wherein the two bundles cross within the transverse passage.

11. The peep sight of claim 10 wherein the peep sight body includes a base portion with the upper portion and the lower portion extending rearward from the base portion.

12. The peep sight of claim 11 wherein the two bundles extend along opposing lateral sides of the upper portion within a pair of upper side grooves, and wherein the two bundles extend along opposing lateral sides of the lower portion within a pair of lower side grooves.

13. The peep sight of claim 12, wherein the upper portion defines a cap portion connected to the base portion between the upper side grooves, with edges of the cap portion extending to define edges of the upper side grooves, and wherein the lower portion defines a cap portion connected to the base portion between the lower side grooves, with edges of the cap portion extending to define edges of the lower side grooves.

14. The peep sight of claim 11, wherein the base portion, the upper portion and the lower portion are formed as an integral piece.

15. A peep sight with an archery bow having a bowstring formed of a plurality of fibers, comprising:

a. a peep sight upper portion with a pair of lateral sides and a peep sight lower portion with a pair of lateral sides, wherein the upper portion and lower portion are spaced apart to define a transverse passage;

b. a sight window defined through at least one of the upper portion and the lower portion;

c. wherein the bowstring fibers are separated into two groups between an upper junction where the groups diverge and a lower junction where the groups converge; and, d. wherein each fiber passes along one lateral side of the upper portion, passes along the opposite lateral side of the lower portion, and switches from one lateral side to the opposite lateral side within the transverse passage.

16. The peep sight of claim 15, wherein the upper portion defines a pair of upper side grooves to receive fibers along opposing lateral sides of the upper portion, and wherein the lower portion defines a pair of lower side grooves to receive fibers along opposing lateral sides of the lower portion.

17. The peep sight of claim 15, wherein longitudinal tension in the bowstring tightens the fibers around the peep sight to lock the peep sight in the bowstring.

18. The peep sight of claim 15, wherein the upper portion and the lower portion are portions of an integral piece.

19. The peep sight of claim 15, wherein the peep sight includes a base portion with the upper portion and the lower portion extending perpendicular from the base portion.

* * * * *